US008936263B2

(12) United States Patent
Rawlins

(10) Patent No.: US 8,936,263 B2
(45) Date of Patent: Jan. 20, 2015

(54) EXTRUDED ADJUSTABLE SKATEBOARD

(71) Applicant: Joel Rawlins, Douglas, GA (US)

(72) Inventor: Joel Rawlins, Douglas, GA (US)

( * ) Notice: Subject to any disclaimer, the term of this patent is extended or adjusted under 35 U.S.C. 154(b) by 0 days.

(21) Appl. No.: 13/974,141

(22) Filed: Aug. 23, 2013

(65) Prior Publication Data

US 2014/0062045 A1 Mar. 6, 2014

Related U.S. Application Data

(60) Provisional application No. 61/695,461, filed on Aug. 31, 2012.

(51) Int. Cl.
*A63C 17/01* (2006.01)
*A63C 17/00* (2006.01)
*A63C 17/26* (2006.01)

(52) U.S. Cl.
CPC ..... *A63C 17/012* (2013.01); *A63C 17/0093* (2013.01); *A63C 17/265* (2013.01); *A63C 17/015* (2013.01); *A63C 2203/42* (2013.01)
USPC ..... 280/87.042

(58) Field of Classification Search
CPC .... A63C 17/01; A63C 17/016; A63C 17/015; A63C 5/00
USPC ..... 280/87.042, 87.041, 326, 79.11, 249, 280/11.28, 11.27
See application file for complete search history.

(56) References Cited

U.S. PATENT DOCUMENTS 829,353 A * 8/1906 Rand ..... 452/17
3,235,282 A 2/1966 Bostick
3,877,623 A * 4/1975 Breault ..... 294/147
4,029,330 A 6/1977 Runyan, Jr.
4,076,265 A 2/1978 Eash, II
4,120,510 A 10/1978 Hillard
4,165,089 A 8/1979 Urdea et al.
4,194,752 A 3/1980 Tilch et al.
5,201,659 A * 4/1993 Nelson ..... 280/87.042
5,267,743 A * 12/1993 Smisek ..... 280/87.042
5,484,149 A 1/1996 Lee
5,645,291 A 7/1997 Ramage
5,997,018 A * 12/1999 Lee ..... 280/87.042
D428,454 S * 7/2000 Fischer et al. ..... D21/662
6,105,978 A 8/2000 Vuerchoz
6,131,931 A 10/2000 Globerson et al.

(Continued)

OTHER PUBLICATIONS

Notification of Transmittal, International Search Report and the Written Opinion of the International Searching Authority dated Dec. 5, 2013, from the corresponding International Application No. PCT/US2013/056349 filed Aug. 23, 2013.

*Primary Examiner* — Hau Phan
(74) *Attorney, Agent, or Firm* — Young Basile

(57) ABSTRACT

Embodiments are provided of skateboard decks and skateboard assemblies each having a unitary body of extruded aluminum, the body having a top surface, a bottom surface, a first longitudinal edge and a second longitudinal edge. Each embodiment can have a handle portion formed in the unitary body and configured to receive one or more fingers, the handle portion positioned proximate one of the first longitudinal edge and the second longitudinal edge. Each of the embodiments disclosed herein can also comprise a first truck rail and a second truck rail extruded with the unitary body on the bottom surface, the first truck rail and the second truck rail running along at least a portion of a length of the unitary body and forming a track configured to movably receive a plurality of truck assemblies.

17 Claims, 5 Drawing Sheets

(56) References Cited

U.S. PATENT DOCUMENTS

| | | | | |
|---|---|---|---|---|
| 6,203,037 | B1 | 3/2001 | Wilson et al. | |
| 6,273,440 | B1 * | 8/2001 | Wilson | 280/87.042 |
| 6,457,731 | B1 * | 10/2002 | Paranto et al. | 280/249 |
| 6,520,518 | B2 * | 2/2003 | Lo | 280/87.041 |
| 6,932,362 | B1 | 8/2005 | Barrett | |
| 6,981,710 | B2 | 1/2006 | Cheng | |
| 7,070,193 | B2 | 7/2006 | Yamaguchi | |
| 7,080,845 | B2 | 7/2006 | Inchley | |
| 7,213,819 | B2 * | 5/2007 | Carbonero | 280/79.11 |
| 7,243,925 | B2 | 7/2007 | Lukoszek | |
| 7,681,248 | B2 * | 3/2010 | Legenstein | 280/11.19 |
| 7,837,204 | B1 | 11/2010 | Groenenboom | |
| 8,079,604 | B2 | 12/2011 | Newton | |
| 2005/0275173 | A1 * | 12/2005 | Hernandez et al. | 280/32.6 |
| 2006/0279055 | A1 * | 12/2006 | Morabito | 280/87.042 |
| 2008/0042387 | A1 | 2/2008 | Lesko | |
| 2008/0129004 | A1 | 6/2008 | Magee | |
| 2010/0304873 | A1 | 12/2010 | Markowitz et al. | |
| 2011/0221150 | A1 | 9/2011 | Harris | |

* cited by examiner

EXTRUDED ADJUSTABLE SKATEBOARD

CROSS REFERENCE TO RELATED APPLICATION

This application claims priority to U.S. Provisional Application Ser. No. 61/695,461 filed on Aug. 31, 2012, which is incorporated by reference herein in its entirety.

TECHNICAL FIELD

The embodiments relate in general to skateboards generally used for recreational purposes.

BACKGROUND

Conventional skateboards generally consist of a deck with front and rear wheel assemblies secured to the underside of the board. These wheel assemblies usually comprise a truck with an axle and two wheels. The decks are constructed of wood or a plastic material and are a finite length with a finite location of the wheel assembly. Conventional skateboards are unwieldy to carry.

BRIEF SUMMARY

Disclosed herein are embodiments of skateboard decks and skateboard assemblies each having a unitary body of extruded aluminum, the body having a top surface, a bottom surface, a first longitudinal edge and a second longitudinal edge. Each embodiment can further have a handle portion formed in the unitary body and configured to receive one or more fingers, the handle portion positioned proximate one of the first longitudinal edge and the second longitudinal edge.

Each of the embodiments disclosed herein can also comprise a first truck rail and a second truck rail extruded with the unitary body on the bottom surface, the first truck rail and the second truck rail running along at least a portion of a length of the unitary body and forming a track configured to movably receive a plurality of truck assemblies.

Embodiments of the skateboard assemblies also comprise a plurality of truck assemblies attached to the bottom surface. In certain embodiments, each truck assembly has a guide portion movably receivable in a track and selectively positionable along a length of the track.

These and other objects, advantages, and features of the invention will become apparent to those persons skilled in the art upon reading the details of the embodiments as more fully described below.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity. Included in the drawings are the following figures.

DETAILED DESCRIPTION OF EMBODIMENTS

Figure 1:
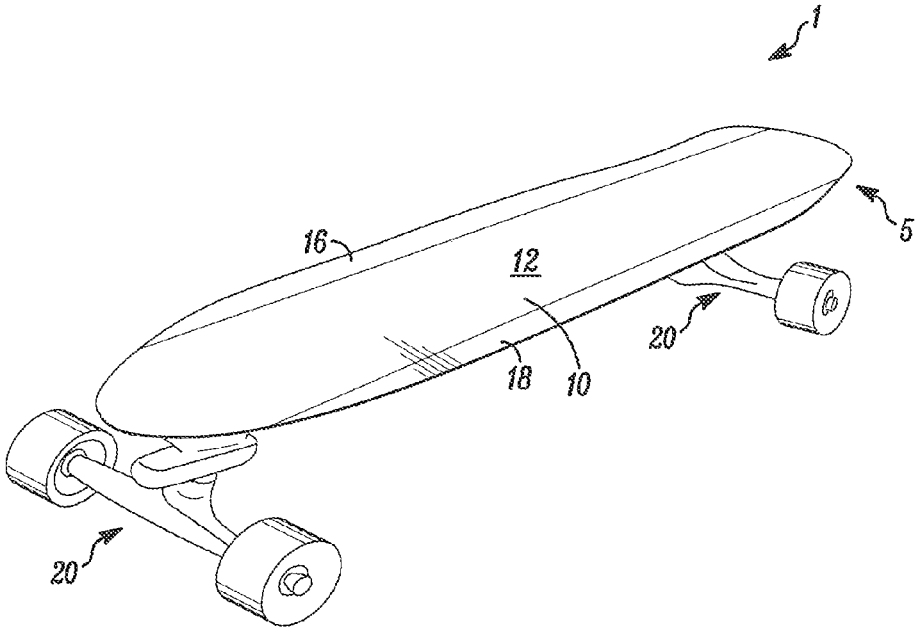
FIG. 1 is a perspective view of a skateboard deck and assembly as disclosed herein.

FIG. 1 is a perspective view of one embodiment of skateboard assembly 1 disclosed herein. The skateboard deck 5 is a unitary body 10 of extruded aluminum with a top surface 12, a bottom surface 14, a first longitudinal edge 16 and a second longitudinal edge 18. Aluminum, as used herein, includes aluminum alloys. By extruding aluminum to form the unitary body of the deck, the deck dimensions can be easily altered to produce custom sized and shaped skateboard decks. The extrusion provides flexible decks, providing improved riding dynamics while supporting the skater's weight. The extruded aluminum can be anodized or sublimated to provide unique colors and finishes that will not wear away with use. Other advantages of an extruded aluminum deck are discussed herein below.

Figure 2:
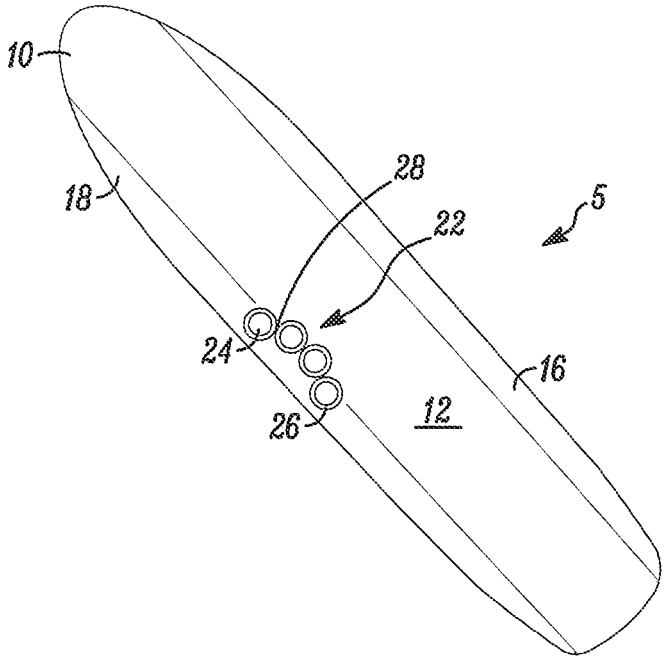
FIG. 2 is a plan view of an embodiment of a skateboard deck as disclosed herein.
Figure 3:
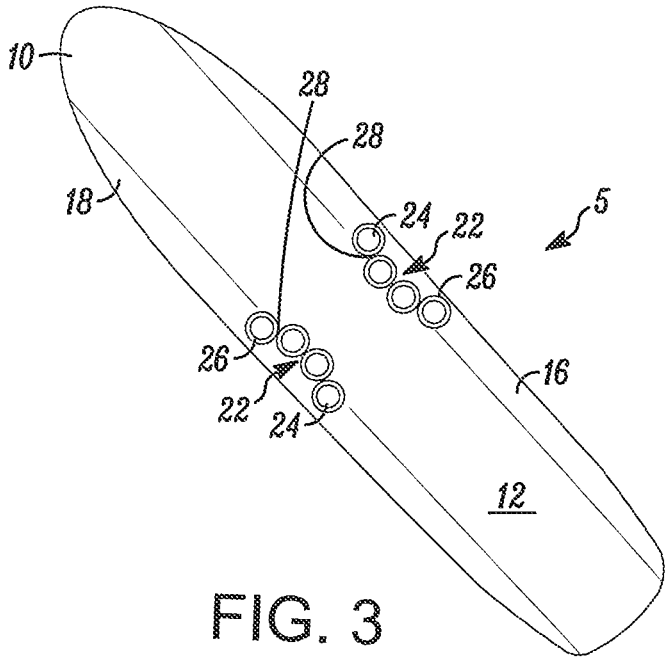
FIG. 3 is a plan view of another embodiment of a skateboard deck as disclosed herein.

The top surface 12 of the unitary body 10 is configured to support a skater. The bottom surface 14 of the unitary body 10 is configured to retain truck assemblies 20, as seen in FIG. 1. FIGS. 2 and 3 are plan views of the top surface 12 of the unitary body 10 of other embodiments. As seen in each of FIGS. 1 to 3, the extrusion process creates longitudinal edges 16, 18 that are slightly flared upward, away from ground level when the skateboard is resting on the ground. The flared edges provide a feeling of comfort and sure-footing to the skater.

The skateboard deck 5 in FIG. 2 has a unitary body 10 in which a handle portion 22 is formed proximate to one of the longitudinal edges 16, 18. The handle portion 22 can be cut or stamped, as non-limiting examples. The extruded aluminum unitary body 10 has sufficient strength that aperture or apertures forming the handle portion 22 will not weaken that portion of the deck 5 to the point of damage when supporting the weight of a skater. Conventional decks of wood or laminate do not have handle portions as weakened portions of the deck (i.e., the narrow portions between the longitudinal edge and the aperture or apertures, as well as between apertures) would not support the weight of the skater.

The handle portion 22 is configured to receive one or more fingers of the skater. The handle portion 22 can be an elongated aperture sized to receive four fingers of the skater. As another example, and shown in FIG. 2, the handle portion 22 comprises four cutout portions 24 each configured to receive a finger there through. The separate finger cutouts 24 are preferable as the bridge portion 28 between finger cutouts 24 provides additional strength to that portion of the deck 5 when compared to a larger cutout portion. A handle portion 22 can also be fitted with a grommet 26 of a polymer material such as rubber for comfort. FIG. 2 illustrates each of the four cutout portions 24 fitted with a grommet 26.

The deck 5 in FIG. 3 is similar to the deck 5 in FIG. 2 but also includes an additional handle portion 30 formed in the unitary body 10 proximate the other longitudinal edge 16, 18 opposite the first handle portion 22.

Figure 4:
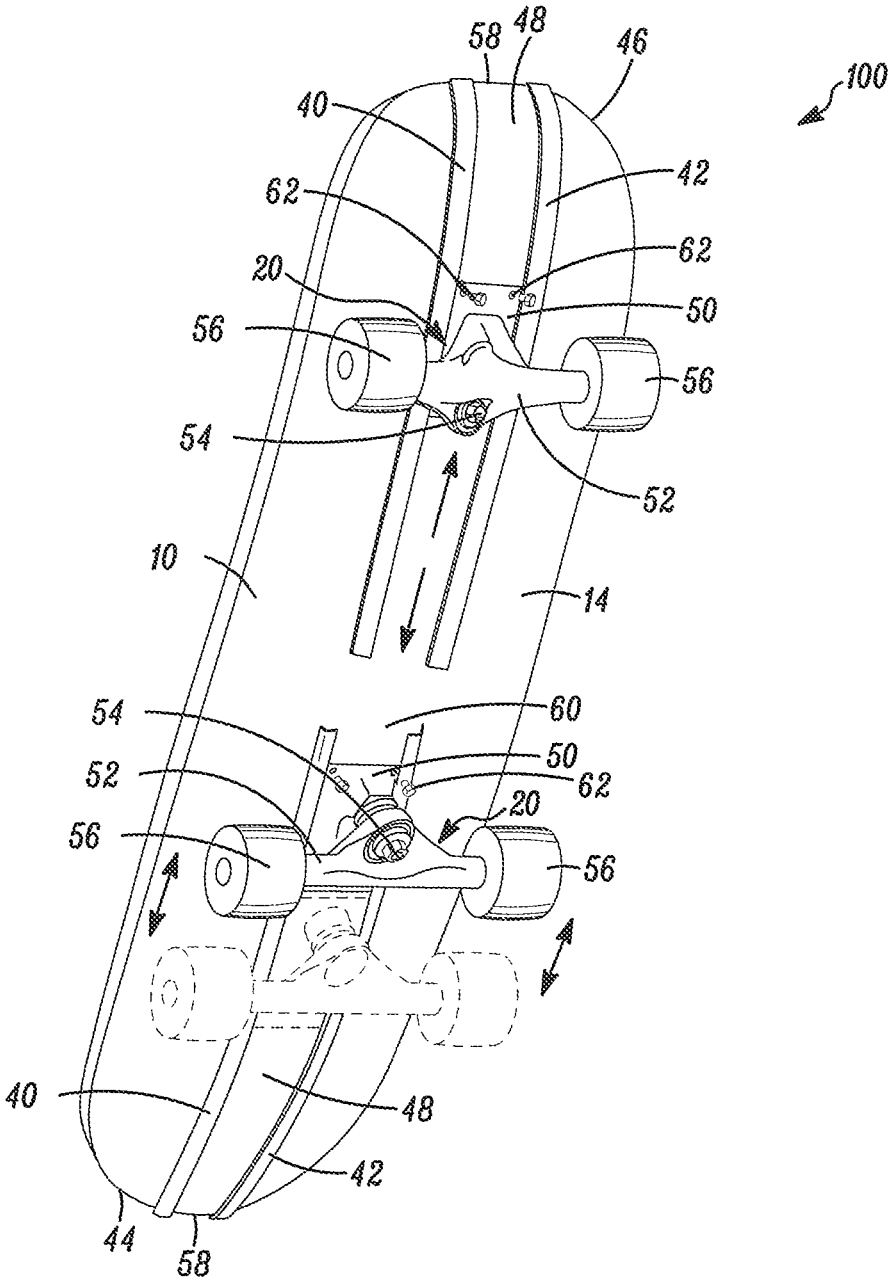
FIG. 4 is a perspective bottom view of a skateboard assembly as disclosed herein.

FIG. 4 is a perspective view of a bottom surface 14 of another embodiment of a skateboard deck and assembly 100. As shown, a first truck rail 40 and a second truck rail 42 are extruded with the unitary body 10 on the bottom surface 14. The first truck rail 40 and the second truck rail 42 run along at least a portion of a length of the unitary body 10. As shown in FIG. 4, the truck rails 40, 42 are shown running along a majority of the length but with a break in the rails proximate the middle of the unitary body 10. This is provided by means of example and is not meant to be limiting. The truck rails 40, 42 can run continuously along the length of the body 10, or can be broken up in a different manner than that shown in FIG. 4. Running the continuous length of the unitary body 10 means starting at or near a front end 44 and ending at or near a rear end 46 of the unitary body 10.

Figure 5:
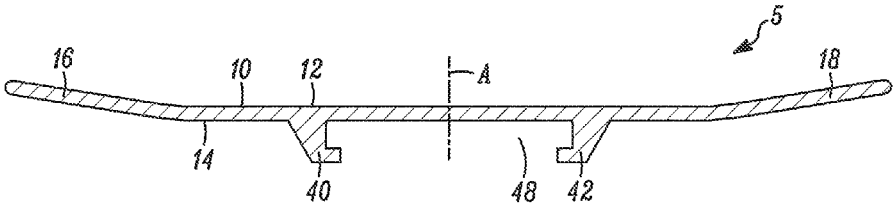
FIG. 5 is a cross sectional view of a skateboard deck having a unitary body extruded with truck rails.

By extruding the unitary body 10 with the truck rails 40, 42, the remainder of the unitary body 10 can be thinner than without the truck rails 40, 42. The truck rails 40, 42 provide support to the thinner unitary body 10 that would otherwise need to be obtained through a thicker cross-section of the body 10. FIG. 5 is a cross-sectional view of the deck 5 of FIG. 4 illustrating the truck rails 40, 42. The truck rails 40, 42 define a track 48 configured to movably receive a plurality of truck assemblies 20. The truck rails 40, 42 can be L-shaped as illustrated or can be another shape that is configured to define the track 48. The track 48 can extend the length of the unitary body 10, any section thereof, or in multiple sections. As illustrated, the truck rails 40, 42 are formed equidistantly on opposing sides of a longitudinal center axis A of the unitary body 10.

Each truck assembly 20 can include a baseplate 50 and a hanger 52, which have bushings in between. A bolt or kingpin 54 holds these together and can be tightened or loosened to adjust the turning and stability of the truck assembly 20. The hanger 52 also supports the axle on which wheels 56 are mounted.

Figure 6:
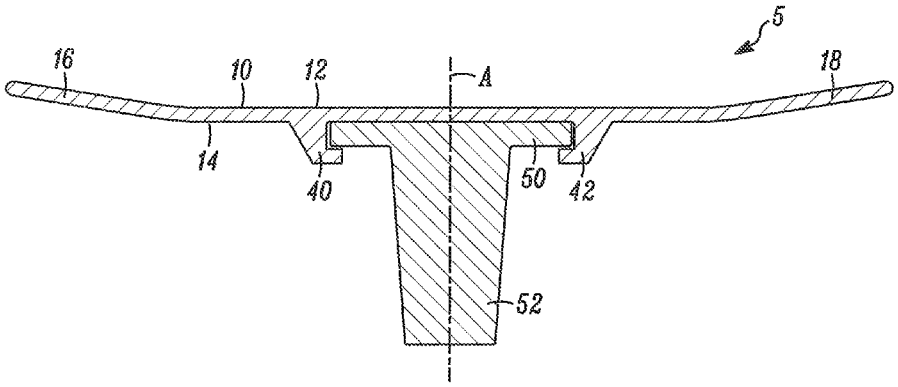
FIG. 6 is the cross sectional view of the skateboard deck of FIG. 5 with a hanger and baseplate in the track.

The baseplate 50 of the truck assembly 52 is a guide portion that is movably receivable in the track 48 and selectively positionable along a length of the track 48. FIG. 6 is a cross-sectional view of the skateboard deck 10 including the hanger 52 and baseplate 50. Each truck assembly 20 is positioned on the skateboard deck 5 by moving the baseplate 50 along the track 48 until the desired position is reached. Note that two truck assemblies 20 are shown by means of example, but additional truck assemblies as desired or required can be used. The truck assemblies 20 can be slid onto the track 48 at an end 58 of the track 48, such as when the track 48 extends the length of the body 10. The truck assemblies 20 may also be slid onto the track 48 via a break 60 in the track 48, such as the break 60 shown in FIG. 4.

The truck assemblies 20 can be attached at the determined position within the track 48 by tightening fasteners 62 through fastener apertures within the baseplate 50 against the bottom surface 14 of the body 10 within the track 48. The fasteners 62 can be screws, clips, pegs, nails, or any other member capable of anchoring the baseplate 50 to the unitary body 10 of the skateboard deck 10. As a non-limiting example, the fasteners 62 are screws with a hex head (compatible with an Allen wrench kit). The fasteners 62 are inserted into apertures in the baseplate 50 and attach the truck assembly 20 to the unitary body 10 by tightening fasteners 62 against the bottom surface 14 within the track 48. The apertures and fasteners 62 can be threaded. By tightening the fastener 62 against the bottom surface 14 rather than inserting fasteners into predetermined receivers along the track, the available positions along the track 48 for the trunk assemblies 20 is not restricted.

The track 48 can be configured and sized to allow a certain standard size truck assembly to be used with the deck 10 or can require custom truck assemblies for use with the skateboard deck 10. If the truck assemblies are standard-sized, a skateboard assembly 1 can include a tap which can alter the size of the pre-drilled holes to a size that would allow use with the fasteners 62 provided with the skateboard deck 10.

Another embodiment of a skateboard deck 5 includes a first channel 70 formed adjacent the first truck rail 40 and a second channel 72 formed adjacent the second truck rail 42. Each channel 70, 72 may receive a protective strip 74, as illustrated in FIG. 8.

Figure 7:
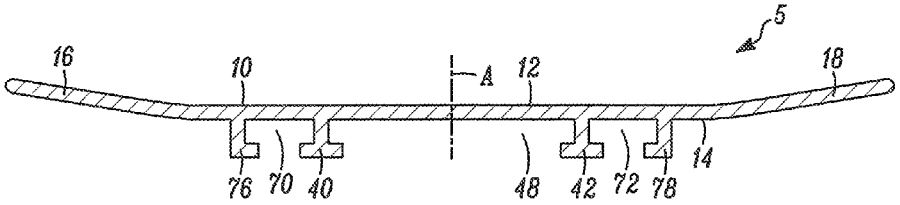
FIG. 7 is a cross sectional view of another embodiment of a skateboard deck having channels.
Figure 8:
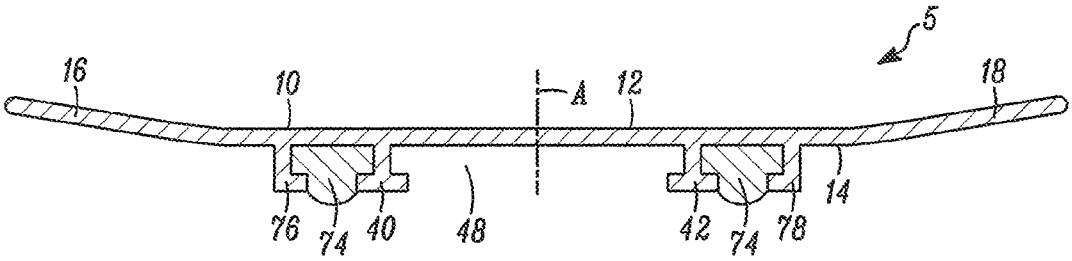
FIG. 8 is the cross sectional view of FIG. 7 including protective strips.

FIGS. 7 and 8 illustrate a skateboard deck 5 including the channels 70, 72. In this embodiment, the first channel 70 is formed between the first truck rail 40 and a first wall 76 running parallel to the first truck rail 40. The second channel 72 is formed between the second truck rail 42 and a second wall 78 running parallel to the second truck rail 42. The unitary body 10 shown in FIGS. 7 and 8 is extruded with both truck rails 40, 42 and walls 76, 78 so that the truck rails 40, 42 and walls 76, 78 are integral to the body 10.

As shown in this embodiment, the truck rails 40, 42 are T-shaped to provide both the track 48 and the channels 70, 72. However, this is a non-limiting example. The truck rails 40, 42 need only provide a side support for the channel and can be any other shape that provides the side support. The walls 76, 78 are also illustrated as L-shaped. However, this is a non-limiting example and may be any other shape that provides side support to the channel 70, 72.

The channels 70, 72 may be left empty, with the walls 76, 78 adding additional support to the unitary body 10, as shown in FIG. 7. The channels 70, 72 may also be at least partially filled with a protective strip 74 as mentioned and shown in FIG. 8. The protective strip 74 can alter the board's characteristics when the skateboard deck 10 comes in contact with objects. It is common for users to perform maneuvers and tricks that require the skateboard deck to contact the other hard surfaces, such as hand rails, stairs, ramp edges, and other surfaces. One technique where the bottom surface 14 of the deck 5 contacts such surfaces is known as "grinding," where a rider will slide along a hard surface on the bottom of the skateboard. The protective strip 74 can protect the underside of the deck 5 against wear and tear from such maneuvers. The protective strip 74 can have a higher coefficient of friction than the unitary body 10, to allow for a slower, more controlled movement. For example, the protective strip 74 may be a nylon cord which is retained in the channels 70, 72. The nylon would provide a consistent slower moving surface against certain hard or metal objects.

The protective strip 74 can be held in the channels 70, 72 with a friction fit, with adhesive, due to the shape of the walls 76, 78 and truck rails 40, 42, or any other means known to those skilled in the art.

Figure 9A:
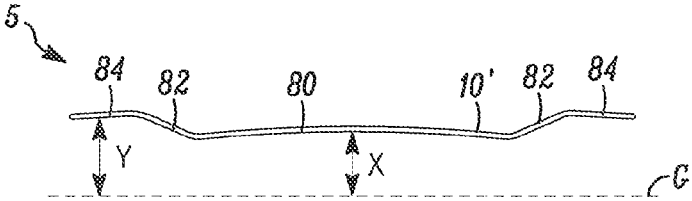
FIG. 9A is a side view of another embodiment of a skateboard deck disclosed herein.
Figure 9B:
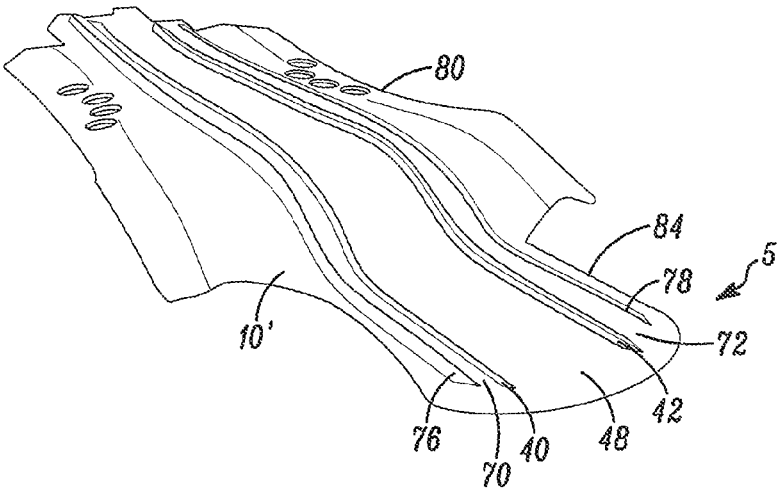
FIG. 9B is a perspective bottom view of the skateboard deck of FIG. 9A.

FIGS. 9A and 9B illustrate another embodiment of a skateboard deck 5 disclosed herein. The unitary body is a contoured unitary body 10' having level surfaces with different heights with respect to ground level G. FIG. 9A illustrates an example of the contoured unitary body 10' having first surface 80, inclined surfaces 82 and second surfaces 84. The first surface 80 is level X from ground level G and the second surfaces 84 are level Y from ground level G. Different contours and levels can be incorporated into the extruded unitary body 10'. The contours can features a drop-down design to aid in balance, stability, and energy efficiency. The contours can assist the skater's feet to fit snugly into the board for a better grip. The contours can provide gas pedals and brakes to the corners.

Because the truck rails 40, 42 and walls 76, 78 are extruded with the unitary body, the contoured unitary body 10' can be extruded with one or both of the truck rails 40, 42 and walls 76, 78 as shown in FIG. 9B. Although both the truck rails 40, 42 and walls 76, 78 run the length of the unitary body 10', one or both of the truck tracks 40, 42 and walls 76, 78 can run only a partial length or be broken along the length of the body 10'.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

It is appreciated that certain features of the skateboard deck and assemblies, which are, for clarity, described in the context of separate embodiments, may also be provided in combination in a single embodiment. Conversely, various features of the skateboard deck and assemblies, which are, for brevity, described in the context of a single embodiment, may also be provided separately or in any suitable sub-combination. All combinations of the embodiments are specifically embraced by the present invention and are disclosed herein just as if each and every combination was individually and explicitly disclosed, to the extent that such combinations embrace operable processes and/or devices/systems/kits. In addition, all sub-combinations listed in the embodiments describing such variables are also specifically embraced by the present skateboard decks and assemblies and are disclosed herein just as if each and every such sub-combination was individually and explicitly disclosed herein.

What is claimed is:

1. A skateboard deck comprising:

a unitary body of extruded aluminum, the body having a top surface, a bottom surface, a first longitudinal edge and a second longitudinal edge, and a first truck rail and a second truck rail extruded with the unitary body on the bottom surface, the first truck rail and the second truck rail running along at least a portion of a length of the unitary body and forming a track configured to movably receive a plurality of truck assemblies.

2. The skateboard deck of claim 1 further comprising:

a handle portion formed in the unitary body and configured to receive one or more fingers, the handle portion positioned proximate one of the first longitudinal edge and the second longitudinal edge.

3. The skateboard deck of claim 2 further comprising:

an additional handle portion formed in the unitary body and configured to receive one or more fingers, the additional handle portion positioned proximate another of the first longitudinal edge and the second longitudinal edge.

4. The skateboard deck of claim 2, wherein the handle portion comprises four cutout portions each configured to receive a finger there through.

5. The skateboard deck of claim 4, wherein each of the four cutout portions is fitted with a grommet of a polymer material.

6. The skateboard deck of claim 1, wherein the first truck rail and the second truck rail run a length of the unitary body continuously from a front end to a rear end of the unitary body.

7. The skateboard deck of claim 1, wherein the unitary body further comprises:

a first channel formed adjacent the first truck rail and a second channel formed adjacent the second truck rail.

8. The skateboard deck of claim 7, wherein each of the first channel and second channel is configured to receive a protective strip.

9. The skateboard deck of claim 7, wherein the first channel is formed between the first truck rail and a first wall running parallel to the first truck rail and the second channel is formed between the second truck rail an a second wall running parallel to the second truck rail, the first wall and second wall extruded with the unitary body.

10. The skateboard deck of claim 1, wherein the first longitudinal edge and the second longitudinal edge are flared upward during extrusion.

11. The skateboard deck of claim 1, wherein the unitary body is a contoured unitary body having level surfaces with different heights with respect to ground level.

12. The skateboard deck of claim 11, wherein the first truck rail and the second truck rail run a length of the contoured unitary body continuously from a front end to a rear end of the contoured unitary body.

13. A skateboard assembly, comprising:

a unitary body of extruded aluminum, the body having a top surface, a bottom surface, a first longitudinal edge and a second longitudinal edge;

a first truck rail and a second truck rail extruded with the unitary body on the bottom surface, the first truck rail and the second truck rail running along at least a portion of a length of the unitary body and forming a track; and a plurality of truck assemblies attached to the bottom surface, wherein each of the plurality of truck assemblies comprises a guide portion movably receivable in the track and selectively positionable along a length of the track.

14. The skateboard assembly of claim 13, wherein the first truck rail and the second truck rail run a length of the unitary body continuously from a front end to a rear end of the unitary body.

15. The skateboard assembly of claim 13, wherein the unitary body further comprises:

a first channel formed adjacent the first truck rail and a second channel formed adjacent the second truck rail, each of the first channel and second channel configured to receive a protective strip.

16. The skateboard assembly of claim 13 further comprising:

a handle portion formed in the unitary body and configured to receive one or more fingers, the handle portion positioned proximate one of the first longitudinal edge and the second longitudinal edge.

17. The skateboard assembly of claim 16 further comprising:

an additional handle portion formed in the unitary body and configured to receive one or more fingers, the additional handle portion positioned proximate another of the first longitudinal edge and the second longitudinal edge.

* * * * *